United States Patent [19]

Miles

[11] Patent Number: 4,524,558

[45] Date of Patent: Jun. 25, 1985

[54] SHEET HOLDER FOR FOOD DISPENSER

[76] Inventor: Bernard Miles, 119 Trenton Ave., Point Pleasant Beach, N.J. 08742

[21] Appl. No.: 520,575

[22] Filed: Aug. 5, 1983

[51] Int. Cl.[3] ..... B65B 25/08; B65B 35/50; B65B 41/02

[52] U.S. Cl. ..... 53/157; 271/35; 271/165

[58] Field of Search ..... 53/122, 157, 389, 571; 101/279, 280; 271/35, 98, 104, 105, 134, 160, 271/165, 166

[56] References Cited

U.S. PATENT DOCUMENTS

| | | | |
|---|---|---|---|
| 3,851,442 | 12/1974 | Miles | 53/122 |
| 3,976,291 | 8/1976 | Bernardi et al. | 271/104 |
| 4,014,537 | 3/1977 | Stange | 271/35 |

*Primary Examiner*—Robert L. Spruill
*Assistant Examiner*—Richard Mudd
*Attorney, Agent, or Firm*—Edward R. Weingram

[57] ABSTRACT

A device for feeding sheets of paper to be interleaved with a stack of meat patties includes a vertical push rod within a tube which is slidable in a hole in one end of a feed arm. The feed arm is connected at the other end to a vertically oscillating shaft which moves up and down in conjunction with a meat patty ejection arm. The upper surface of the feed arm also supports a pivoting lock plate having one end mounted on a vertical post. The other end of the lock plate includes a hole accommodating the slidable tube. The lower end of the push rod includes a pressure foot which rests on top of a stack of paper sheets. A spring is positioned around the push rod between the pressure foot and the lower end of the slidable tube. When the oscillating shaft moves down, the lock plate pivots to an angular position which causes the slidable tube to be gripped within the hole in the lock plate. The tube is thus moved downward on the push rod to compress the spring which applies pressure against the foot and the stack of papers. This provides the desired force against a moving conveyor belt below the paper stack to permit pulling the bottom sheet from the stack to feed the paper below the patty forming mechanism to properly interleave the paper with the patties.

15 Claims, 17 Drawing Figures

FIG. 9
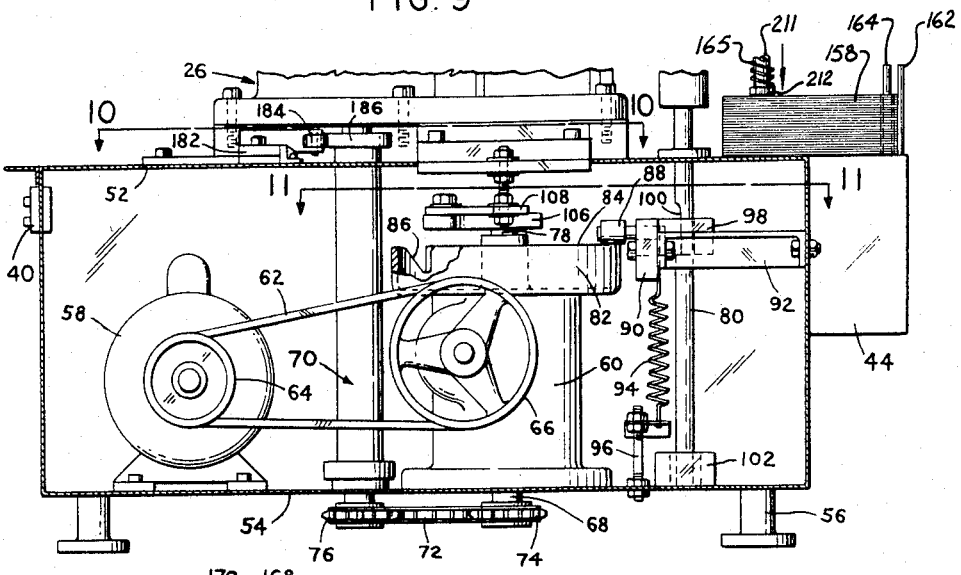
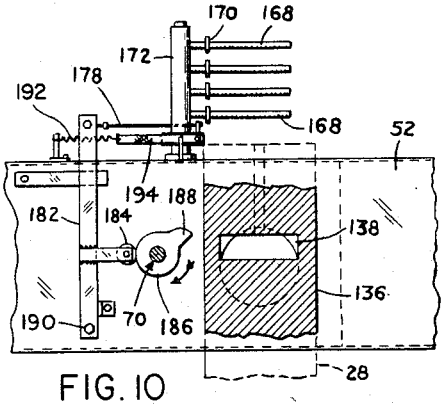
FIG. 10
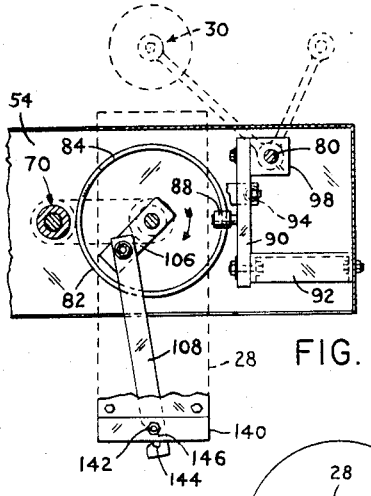
FIG. 11
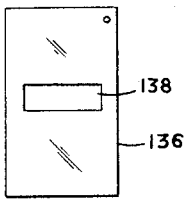
FIG. 12
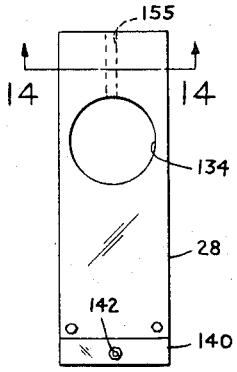
FIG. 13
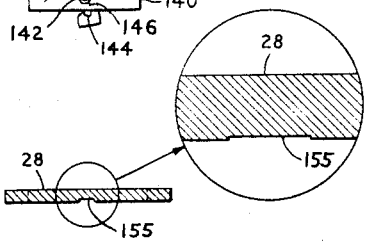
FIG. 14

SHEET HOLDER FOR FOOD DISPENSER

BACKGROUND OF THE INVENTION

1. Field of the Invention

This invention relates to food dispensing equipment and particularly to a device for feeding sheets of paper from a stack to be interleaved with patties of meat.

2. Description of the Prior Art

A presently known device for forming a stack of meat patties and interleaving sheets of paper therebetween is described in U.S. Pat. No. 3,851,442 by the instant inventor. Several shortcomings of that device include the limitation of the amount of paper that could be stacked at one time, the lessening of pressure on the remaining paper when the stack is depleted and the limited force that could be applied for use with heavier and thicker paper, the lack of positive contact of the pressure foot with the last few sheets of paper causing delay or improper interleaving, and the frequent shut down of the equipment in order to replenish the paper supplies.

SUMMARY OF THE INVENTION

It is therefore an object of the present invention to provide apparatus for forming food patties including a device for holding a larger number of interleaving paper sheets.

Another object of the present invention is to provide apparatus for dispensing food patties which can operate continuously for a longer time between shut downs.

It is a further object of this invention to provide a paper feeding device for a food patty dispenser in which the maximum number of sheets can be easily varied.

Still another object of the invention is to provide a paper feeding device for a patty dispenser which automatically adjusts to the height of the paper stack while maintaining constant spring pressure as the stack is depleted.

It is also an object of the present invention to provide a paper feed for a patty dispenser which maintains contact and pressure on the last several sheets of the stack with a positive feed and interleaving action until the end.

A still further object of the invention is to permit a paper feeder for a patty dispenser to accomodate thicker sheets, such as double laminated freezer paper and heavily waxed paper, while maintaining sufficient pressure to tear sheets from the bottom of the stack.

Another object of the invention is to provide a device for feeding paper to a patty dispenser wherein spring tension is readily adjustable by shortening or lengthening the spring.

An additional object of the invention is to provide a paper feed device for a patty dispenser which is easily reset to an appropriate operating height dependent upon the height of the stack.

An added object of this invention is to provide a paper feed device for a patty dispenser which gives a constant indication of the level or supply of sheets.

Yet another object of the invention is to provide a paper feed for a patty dispenser which can use interchangeable parts to vary the capacity of sheets that can be handled or the spring tension.

A further object of the invention is to provide a paper feed device for a patty dispenser which can utilize a screw adjustment to change spring tension.

Another object of the invention is to provide a paper feed for a patty dispenser which can be easily reloaded.

An additional object of the invention is to provide a paper feed for a patty dispenser which is simple to operate and maintain.

An added object of the invention is to provide a paper feed for a patty dispenser which is economical to fabricate.

A still further object of the invention is to provide a paper feed for a patty dispenser which is reliable and durable.

These desirable features and results are achieved with a novel device for holding and feeding sheets of paper to be interleaved with a stack of meat patties which includes an extended vertical rod enclosed within a slidable tube at the upper end and a spring at the lower end. The tube slides within a hole at one end of a feed arm having the other end connected to a vertically oscillating shaft which moves together with a meat patty ejection arm. A pivoting lock plate is mounted on a vertical post on the upper surface of the feed arm and includes a hole at one end which receives the slidable tube. The lower end of the push rod has a pressure foot which rests on the top of a stack of paper sheets. Downward movement of the oscillating shaft causes the lock plate to pivot at an angle so that the hole grips the outer tube and moves the tube down over the push rod. The push rod compresses the spring and applied pressure to the foot and paper stack which is supported over a conveyor belt. Pressure on the stack and movement of the belt cause the bottom sheet to be pulled from a pin holding the stack to feed the paper toward the patty mold and interleave the paper with the patties.

Other objects and advantages will become apparent from the following description in conjunction with the accompanying drawings.

BRIEF DESCRIPTION OF THE DRAWINGS

FIG. 9 is an enlarged back view of the apparatus with the cover removed to show the internal mechanism.

FIG. 10 is a section taken along line 10—10 of FIG. 9.

FIG. 11 is a view taken along line 11—11 of FIG. 9

FIG. 12 is a top view of the fixed spacer plate used in the machine shown in FIG. 1.

FIG. 13 is a top view of the mold plate with a hold cavity used in the machine shown in FIG. 1.

FIG. 14 is a cross section taken along line 14—14 of FIG. 13.

DESCRIPTION OF THE PREFERRED EMBODIMENT

Figure 1:
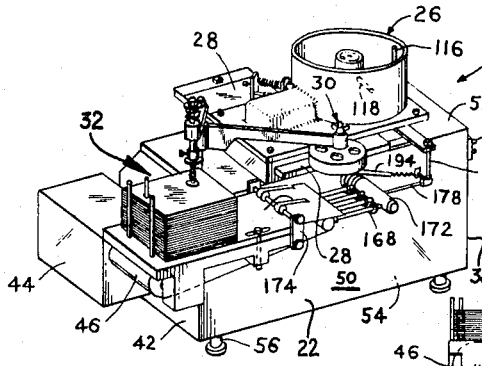
FIG. 1 shows a perspective view of an apparatus for forming, interleaving and dispensing food patties including the improved paper sheet holder and feeder of the present invention.
Figure 2:
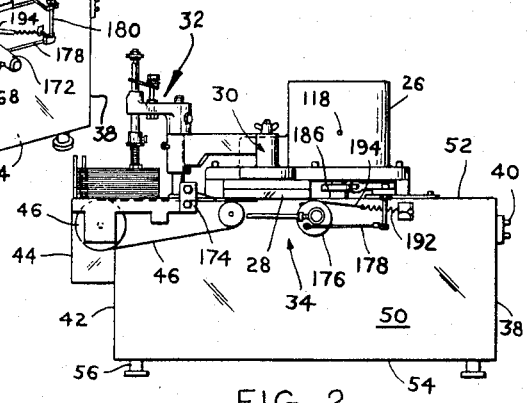
FIG. 2 is a front elevation of the apparatus shown in FIG. 1.
Figure 3:
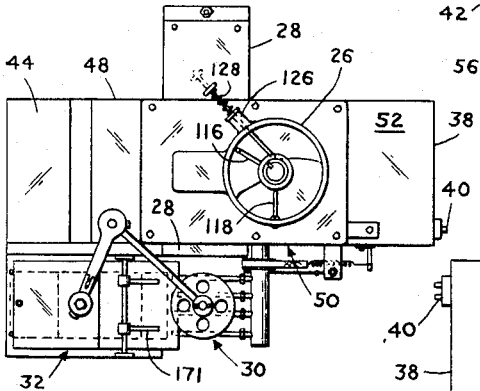
FIG. 3 is a plan view of the apparatus shown in FIG. 1.
Figure 4:
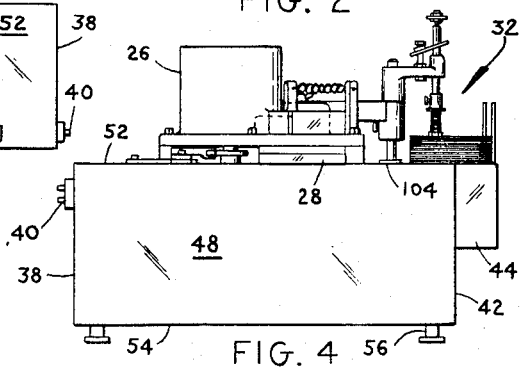
FIG. 4 is a back elevation of the apparatus of FIG. 1.
Figure 5:
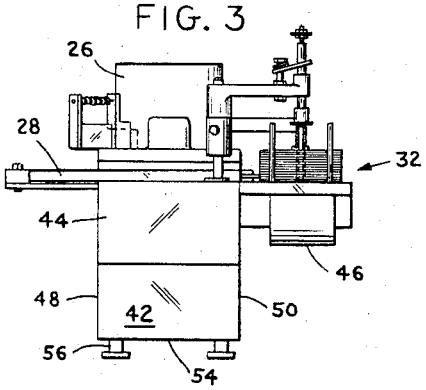
FIG. 5 is a left end elevation of the apparatus of FIG. 2.
Figure 6:
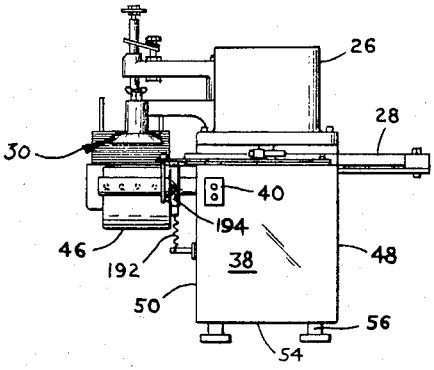
FIG. 6 is a right end elevation of FIG. 2.

As shown in the figures, a machine for forming, interleaving and dispensing food patties, generally indicated at 20, has a housing 22 enclosing a drive system which powers a meat feeding system including a hopper 26 for providing chopped food to a patty forming mold system which includes a mold plate 28 for forming food patties which are then ejected from the mold plate by a mold ejection means, generally indicated at 30. A paper interleaving system, generally indicated at 32, will be more fully described hereinafter. The paper feeding device is disposed at the side of the machine to feed the individual papers from a stack to an interleaving system, generally indicated at 34, which arranges single sheets of paper between successive patties produced by the patty molding unit. The interleaved patties are then arranged in a neat stack, as shown at 36 in FIG. 7.

As shown in FIGS. 1 through 9, the housing 22 consists of a side wall 38 on which is mounted an electric switch 40, an opposite side wall 42 on which is mounted an electric motor for a conveyor belt 46, to be described more fully later, a back wall of housing 48 and a front wall 50. As shown in FIG. 9, the housing also has a top wall 52 and a bottom wall 54, which is supported by a plurality of legs 56.

The housing encloses a drive system consisting of a drive motor 58 mounted to the bottom wall 54 by bolts, as shown in FIG. 9. The drive motor drives a speed reducing transmission 60 through belt 62 connected to a drive motor pulley 64 and transmission pulley 66. A shaft 68 extending from the bottom of transmission 60 drives a rotating vertical shaft 70 through a chain drive 72 connecting evenly sized sprockets 74, 76 on the bottom of the transmission shaft and the vertical rotating shaft respectively to provide a uniform, one-to-one rotational speed between the transmission and the rotating vertical shaft.

A shaft 78 extends upward from the top of the speed reduction transmission 60 and drives a vertical oscillating shaft 80 through a cam 82 which rotates with the output shaft 78. As shown in FIG. 9, the cam 82 has an upper surface 84 with a cut out portion 86. A cam roller 88 is held in engagement with cam surfaces 84, 86 of cam 82 by means of a cam roller lever arm 90 which is supported at one end by a bracket 92 and biased downward by a spring 94 anchored to the base of the housing by a bolt and bracket combination 96. The other end of cam roller lever arm 90 is fastened to a block 98 which, in turn, is fixedly secured to the oscillating vertical shaft 80 at a flat section of the shaft 100 by means of a set screw. The rod 80 moves up and down with relation to the housing and is held in position by means of a base guide 102 anchored to the floor and a top guide bushing 104 connected to the top 52 of the housing. The shaft 78 from the top of transmission 60, in addition to driving cam 82, also drives a crank arm 106 which drives the mold plate 28 through a linkage arm 108.

The vertical rotating shaft 70 drives the meat feeding system, including hopper 26 and the interleaving stacking system shown at 34. The top output shaft of the transmission 60 drives a moldplate 28 and cam 82 which, in turn, drives vertical oscillating shaft 80. Shaft 80 then powers the mold ejection means 30 and a substantial portion of the paper dispensing means.

Figure 8:
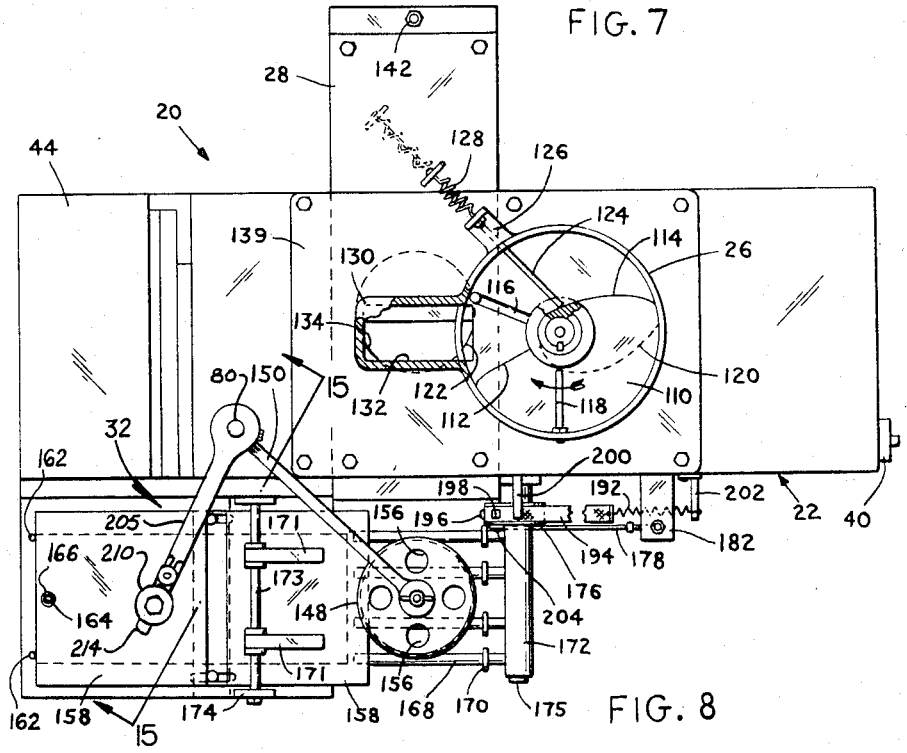
FIG. 8 is an enlarged top view of the apparatus.

The first step in processing the food material, such as meat, consists of placing a quantity of the previously chopped meat into the meat hopper 26, where the meat is stirred and mixed to a uniform consistency and fed in small quantities to the patty molding system. A meat feeder unit 110 is rotating by vertical rotating shaft 70 within hopper 26 and has a leading edge 112 and trailing edge 114, as shown in FIG. 8, and a stirring rod 116 adapted to rotate with the unit to stir the meat in the hopper in coaction with a meat retaining rod 118 extending from a wall of the hopper. A cam shaped wall 120 on the bottom of the meat feeder serves to push meat from ahead of edge 112 toward outlet port 122 in cooperation with a moveable vane 124 to form a pocket which compresses the meat trapped ahead of the cam shaped wall. The cam wall 120 also coacts with moveable vane 124 to force the vane to slide in the vane housing 126 against the urging of spring 128 so that the vane will be out of the way to permit the meat feeding unit to continue revolving in the hopper.

The opening 122 from hopper 26 leads to a housing 130 having a rectangular opening 132 through which the meat forced from the hopper will pass under pressure of the rotating feed unit to fill the patty molding system.

As shown in FIGS. 8 through 14, the patty molding system consists of a mold plate 28 having a mold cavity 134. The thickness of the plate and size and shape of the mold cavity can vary and will determine the size and shape of the patty produced. The mold plate 28 is mounted below a spacer plate 136 having a rectangular opening 138 and is fixedly mounted to an upper section 139 on the top of the housing. The mold plate 28 is oscillated in a horizontal plane by the crank 106 and connecting link 108 driven by the upper output shaft of the speed reducing transmission. The connecting link 108 is connected to a back drive unit 140 which is bolted to the end of mold plate 28 and includes a pin 142 extending downward to engage a hook 144 at the end of a timing slot 146 in the end of link 108. As output shaft 78 rotates, crank 106 will rotate in the direction of the arrow shown in FIG. 11, and connecting link 108 will engage pin 142 to oscillate the back drive unit and mold plate 28, thereby moving mold cavity 134 back and forth in a predetermined path. The timing slot 146 at the end of link 108 provides a pause in the travel of mold plate 28, during which time the length of the slot passes over pin 142. The purpose of this pause will be made apparent when discussed below.

Figure 7:
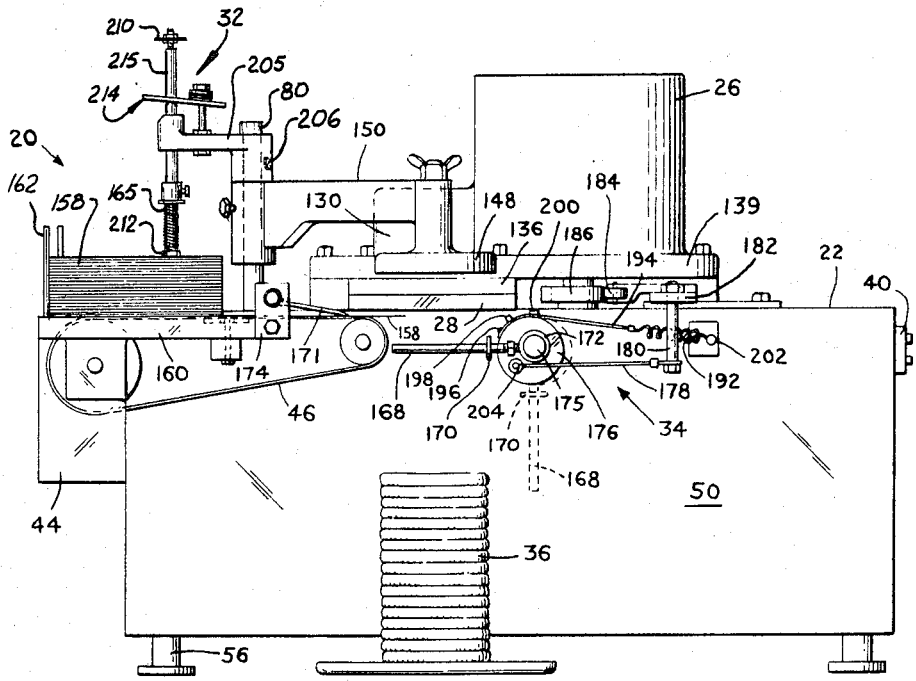
FIG. 7 is an enlarged front view of the apparatus showing the improved paper holder and feed mechanism.

The oscillation of the mold plate 28 brings the mold cavity 134 into registration with rectangular slot 138 in the spacing plate and rectangular opening 132 in the bottom of the outlet housing 130 from the hopper, so that meat which has been forced into the outlet housing by the meat feeder unit will flow through the rectangular passages in the bottom of the housing and spacer plate to fill the mold cavity as it passes under the openings. At the other end of the path of the mold plate, the mold cavity 134 will be positioned directly below the knock out cup 148 of the mold ejection means 30. As shown in FIGS. 7 and 8, the knock out cup 148 is mounted on a patty ejection arm 150 and is secured to the upper end of a vertical oscillating shaft 80 by means of a retainer cylindrical portion connected to shaft 80 by a set screw, and by means of a paper pressure feed arm 205, to be explained later. Thus, when oscillating vertical shaft 80 drops downward due to coaction with cam surface 86 and roller 88, the knock out cup 148 will also come down directly to mold cavity 134 positioned below the arm and filled with meat in the shape of the mold cavity.

As shown in FIGS. 13 and 14, the mold plate 28 has a groove 155 which runs from mold cavity 134 to the front of the mold plate. This groove provides an air passage between the bottom of the mold plate and the top 52 of the housing to permit escape of air from the cavity when being filled with meat. This avoids sealing of the interfaces of the mold cavity and lower surface of spacing plate 136 and the top of the machine housing by fats and oils which would prevent the air from escaping. Large quantities of air trapped in the mold cavity could cause large voids in the patties or prevent sufficient quantities of meat from filling the mold cavity. The top of the knock out cup 148 also has a plurality of holes 156 which allow air into the cup behind the patty to prevent a vacuum from forming between the patty and cup. Such a vacuum could cause the patty to adhere to the cup. The air holes thus assist in releasing the patty from the cup.

The interleaving paper dispensing means, generally shown at 32, operates in synchronism with the mold ejection means 30, since both are actuated by vertical movement of the oscillating shaft 80. The interleaving paper dispenser is shown more clearly in FIGS. 7, 8, 15, 16 and 17, and consists of a motor 44 which drives a conveyor belt 46 or other conveying means on which is placed a stack of individual interleaving paper sheets 158. The papers are supported under the belt by a support bracket 160 and are held in position by two rear pins 162 against which the stack is placed, and by a paper holder pin 164 which extends up through a hole 166 placed in each paper sheet. The motor 44 for the conveyor belt is connected to the main switch 40 of the machine and is automatically turned on when drive motor 58 is on so that the belt is in continuous motion. The stack of papers is prevented from movement by the pin 164 so that they remain stationary until vertical oscillating shaft 80 is pulled downward by spring 94 when cam surface 86 coacts with roller 88.

Figure 15:
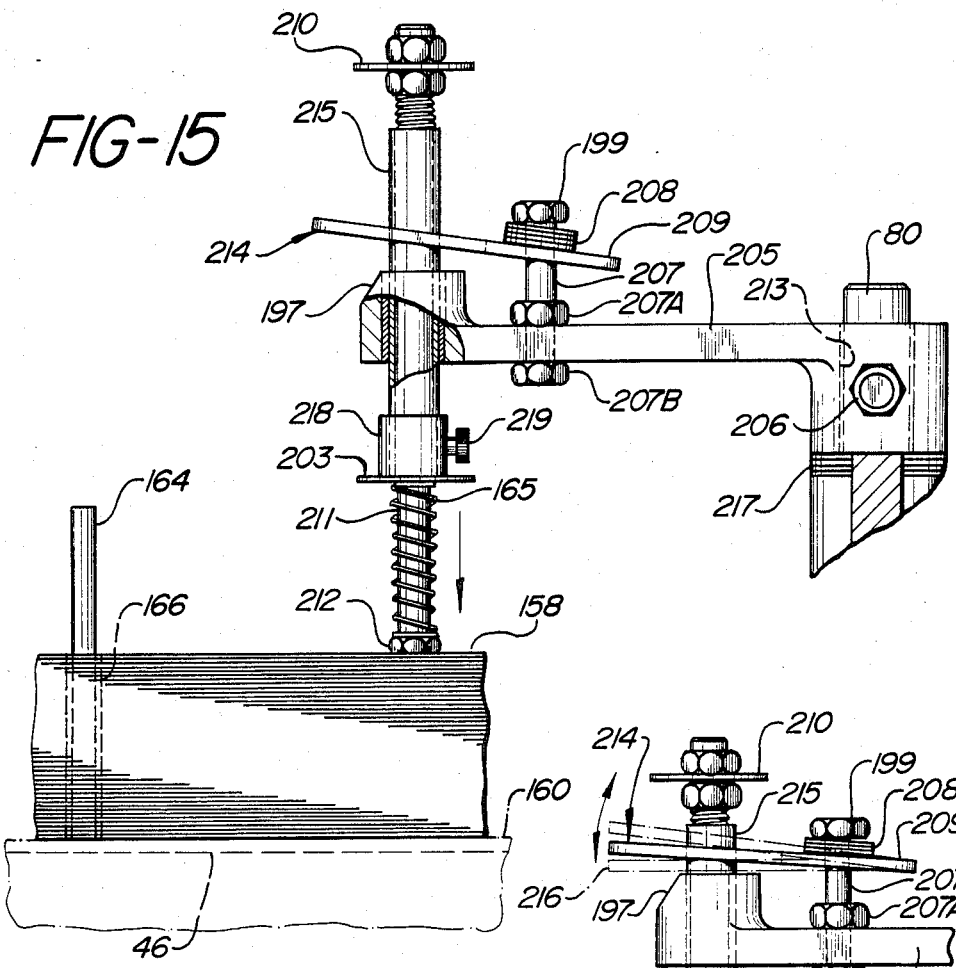
FIG. 15 is an enlarged view in partial cross section taken along line 15—15 of FIG. 8 showing the improved paper sheet holder device in operation with a stack of paper sheets.
Figure 16:
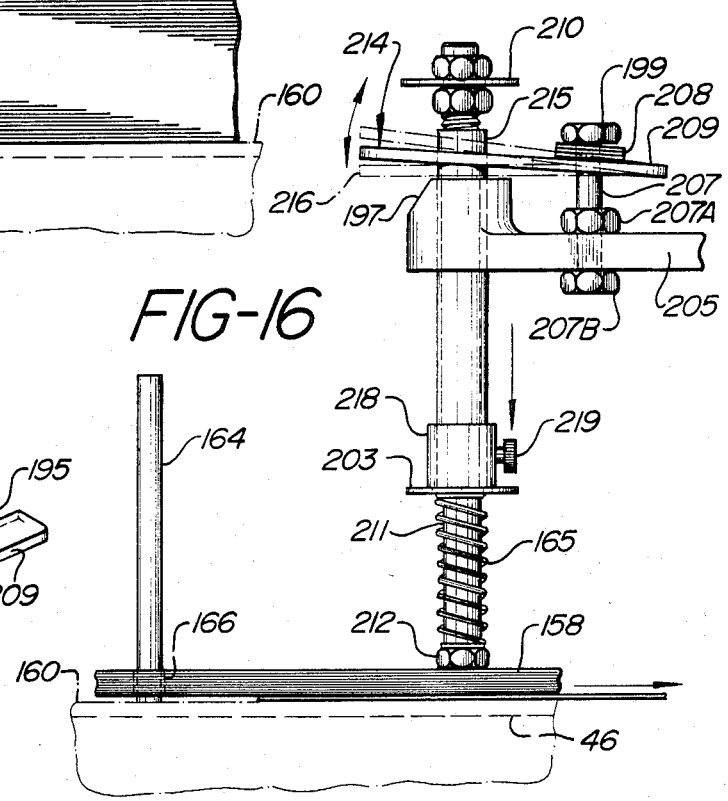
FIG. 16 is another enlarged view of the paper sheet holder showing the operation with a depleted stack of paper sheets.
Figure 17:
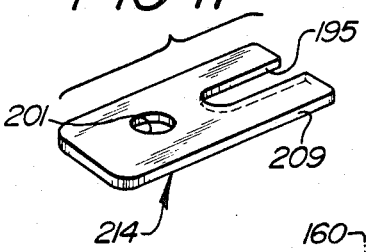
FIG. 17 is an enlarged perspective view of the lock plate of FIGS. 15 and 16.

As shown in further detail in FIGS. 15, 16 and 17, the paper pressure feed arm 205 is secured at one end to shaft 80 by means of a bolt 206 passing through a hub. Shaft 80 fits within a mounting hole 213 in the hub. Mounted on the upper surface of feed arm 205 is a vertical post 207 formed by a bolt 199 threaded through the arm and secured by nuts 207A and 207B. A pivoting lock plate 209 includes a slot 195 at one end which fits over post 207 and a plurality of weighted washers 208 are mounted on the post over the pivoting plate. The other end 214 of the plate includes a hole 201 which receives a vertical slidable tube 215. Tube 215 also passes through a hole 197 through a hub at the other end of feed arm 205. A vertical push rod 211 is mounted within tube 215 and includes a pressure foot 212 at the lower end resting on a stack of paper sheets 158, and a pull up washer and lock nut assembly 210 at the upper end. A push rod spring is mounted over the lower end of the rod 211 between pressure foot 212 and the bottom washer or collar 203 in contact with tube 215.

In operation, when the oscillating shaft moves down, together with arm 205, pivoting lock plate 209 moves from a horizontal position 216 to an angular position, as a result of the unbalanced weight of the plate and washers, with bolt 199 acting as a stop to provide positive engagement of the plate and tube. The angular position causes the plate and hole 201 to grip the tube 215 and pull tube 215 downward over the push rod 211 to compress spring 165. This, in turn, applies pressure against foot 212 and the stack of paper sheets 158. The bottom paper sheet is thus forced down against the moving conveyor belt 46 which pulls the sheet from pin 164 to feed the paper towards the support rods 168 below the patty forming mechanism. When shaft 80 returns to the normal position and moves upward, arm 205 likewise moves upward, causing lock plate 209 to resume a horizontal position. This releases tube 215 and permits spring 165 to expand and move tube 215 and push rod 211 upward to a normal position with the tube collar resting on the spring and the rod foot resting on the reduced paper stack.

Various adjustments can be made to the sheet holder and feed mechanism to accomodate different paper stack heights and sheet thicknesses. For example, the push rod and tube can be made longer and of interchangeable sized parts, a plurality of washers 217 can be inserted under the end of arm 205 on shaft 80 to raise the height of the arm, and springs of varying compressive strengths can be used. The spring tension can also be made adjustable by the addition of a sleeve 218 and screw 219 positioned over the lower end of tube 215, with sleeve 218 fixedly secured to collar 203. By lowering sleeve 218 to a desired position and tightening screw 219 on tube 215, the length of spring 165 is decreased and tension increased.

The pull up washer and nut assembly 210 are used in manually lifting tube 215 to permit loading of paper sheets under pressure foot 212. In order to accomplish this, the operator pushes down on end 214 of the lock plate to lift washers 208 and release any clutching action of the plate on tube 215. The plate then assumes a horizontal position to facilitate loading.

After the bottom sheet of paper is pulled from pin 164 and stack 158, to insure that the paper will continue to move along the conveyor belt, two hold down arms 171 pivotally mounted on a rod 173, which is supported by a bracket 174 connected to the housing, will bear downward on the paper to maintain contact with the conveyor belt. When the sheet reaches the end of the belt, it will fall downward and continue movement to the right as shown in FIG. 7, until it comes to rest on horizontal support rods 168, and is positioned on the rods by movable paper stops 170. The paper is then held in this position until knock out cup 148 ejects a patty from the mold cavity located over the support rods. After the patty is ejected, it will fall a short distance to the top of the sheet of paper held by the rods.

Thereafter, the support rods 168 are rapidly rotated to a vertical position, as shown in FIG. 7, at a speed that is faster than the rate at which the patty and paper can fall, so that the patty and interleaved paper below will fall to form the stack of patties 36. Rods 168 are rotated faster than the patty and paper by connection to a tube 172 rotatably mounted on shaft 175 extending from front wall 50 of the machine housing. A flange 176 on tube 172 is connected by a horizontal link 178 and a vertical link 180 to a lever 182 from which a roller 184 contacts a cam 186 driven by the vertical rotating shaft 70, as shown in FIGS. 7 and 10. The horizontal link is rotatably connected to a pin 204 extending from flange 176 near the periphery of the flange.

The cam 186 has a large sharp rising lobe 188 which, when contacting roller 184, will cause the roller to rapidly move to the left of FIG. 10, thereby rapidly pivoting lever arm 182 about pivot point 190. As seen from the shape of cam lobe 188, support rods 168 are intended to remain in the vertical position for only a very short time. As the cam continues to rotate, lever 182 will be urged to the right to contact cam 186 by spring 192 connected to a strap 194 and the flange 176 of the support rods tube. As shown in FIG. 7, strap 194 is connected to flange 176 by an anchoring button 196. The strap will continue to rotate arms 168 clockwise until the contact stop 198 on flange 176 contacts fixed stop 200 which extends from the machine housing. Spring 192 is anchored to the front wall 50 of the machine housing by means of a pin 202.

A more complete explanation of the general operation of the entire machine is found in the aforementioned U.S. Pat. No. 3,851,442. It is thus apparent that the present invention provides an improved, reliable, simple paper sheet holder and feeding mechanism for a food dispenser which accomodates larger amounts of paper, provides constant pressure for varying heights of a paper stack, permits use of heavier thicker paper sheets, and avoids frequent shut down of the equipment to replenish supplies. While only a limited number of embodiments have been illustrated and described, it is apparent that many other variations may be made, an example of which can be, instead of the pressure foot moving downward to meet top of the stack of interleaving sheets, the stack of interleaving sheets can be urged to move upward to meet the pressure foot. This is only one variation in the particular design and configuration without departing from the scope of the invention as set forth in the appended claims.

What is claimed is:

1. Apparatus for holding and feeding sheets along a conveying means to be interleaved with a stack of formed food patties and actuated by a vertically oscillating shaft comprising:

a feed arm having means at one end for connection to the vertically oscillating shaft, a vertical rod having a pressure foot at the lower end, a slidable tube enclosing the upper portion of said rod, said tube and rod passing through the other end of said feed arm, a spring around the lower end of said rod between the bottom of said tube and said pressure foot, said pressure foot being adapted to rest on the top of a stack of sheets supported over the conveying means below said foot, and pivotable locking means mounted on said feed arm adjacent said slidable tube and having an opening in one end for receiving said tube, said locking means normally resting in a horizontal position and pivoting to an angular position upon downward movement of said vertically oscillating shaft and arm, said locking means and opening in said angular position gripping said tube and moving said tube downwardly against said spring to urge said rod and pressure foot against said stack of sheets and cause the lowermost sheet to be forced against said conveying means to be pulled from said stack and fed along said conveying means for interleaving with said food patties.

2. The apparatus of claim 1 wherein said locking means includes a post mounted on the upper surface of said arm and a locking plate pivotally mounted on said post, said post including a stop at the upper end and weight means over said plate on said post for unbalancing said plate into said angular position upon downward movement of said arm.

3. The apparatus of claim 2 wherein said feed arm includes a hub at said one end having a hole to receive said vertical shaft, a bolt passing through said hub to secure said shaft, and a hole at said other end to receive said tube and rod.

4. The apparatus of claim 2 including means for adjusting the height of said arm.

5. The apparatus of claim 2 including means for adjusting the spring pressure on said pressure foot.

6. The apparatus of claim 2 including a collar at the lower end of said slidable tube.

7. The apparatus of claim 2 including means for pulling said rod at the upper end thereof.

8. Apparatus for interleaving and stacking food patties, comprising:

a support means;

means to periodically dispense individual interleaving sheets onto said support means including a conveying means, a stack of individual sheets disposed on said conveying means, means to hold said stack of individual interleaving sheets on said conveying means, means to press said stack of sheets against said conveying means to cause the single interleaving sheet in contact with said conveying means to separate from said stack of interleaving sheets and be drawn along said conveying means, said means to press said stack of sheets against said conveying means including a vertically oscillating means, a vertical push rod having a pressure foot means to contact the top of said paper stack, a slidable tube means enclosing the upper end of said rod and extending through said vertically oscillating means, spring means disposed around the lower end of said rod between the lower end of said tube means and said foot means, pivotable locking means mounted on said vertical oscillating means and having an end positioned about said slidable tube means, said locking means normally resting in a horizontal position and pivoting to an angular position upon downward movement of said vertical oscillating means so that said end engages said tube means and moves said tube means downwardly over said rod against said spring means to urge said rod and pressure foot means against said stack and cause said single sheet to separate from said stack;

means to periodically dispense formed food patties onto said interleaving sheets on said support means;

means to sequentially synchronize the dispensing of said sheets and patties onto said support means; and means to remove said support means from beneath said sheets and patties on said support means faster than the rate of free fall of said sheets and patties so that said sheets and patties will be free to fall without contacting said support means.

9. The apparatus of claim 8 wherein said means to hold said stack of sheets includes a pin passing through a hole in said sheets, said sheet in contact with said conveying means being pulled from said pin upon pressure from said spring and pressure foot means against said stack and conveying means.

10. The apparatus of claim 8 wherein said vertically oscillating means includes a vertical shaft, a horizontal feed arm having one end connected to said shaft and a hole at the other end for receiving said slidable tube and vertical push rod, said locking means including a vertical post mounted on the upper surface of said feed arm and a locking plate pivotally mounted on said post, said post including a stop at the upper end and weight means over said plate on said post for unbalancing said plate into said angular position upon downward movement of said arm.

11. The apparatus of claim 10 wherein said feed arm includes a hub at said one end having a hole to receive said vertical shaft, a bolt passing through said hub to secure said shaft, and a hole at said other end to receive said tube and rod.

12. The apparatus of claim 10 including means for adjusting the height of said arm.

13. The apparatus of claim 10 including means for adjusting the spring pressure on said pressure foot.

14. The apparatus of claim 10 including a collar at the lower end of said slidable tube.

15. The apparatus of claim 10 including means for pulling said rod at the upper end thereof.

* * * * *